US011615933B2

(12) United States Patent
Lagree et al.

(10) Patent No.: US 11,615,933 B2
(45) Date of Patent: Mar. 28, 2023

(54) SAFETY APPARATUS HAVING TERMINAL SHIELD WITH INDICATION CIRCUIT, AND CIRCUIT INTERRUPTION APPARATUS

(71) Applicant: EATON INTELLIGENT POWER LIMITED, Dublin (IE)

(72) Inventors: James L. Lagree, Robinson Township, PA (US); Manuel Fernandez, Cranberry Township, PA (US); Robert Griffin, Bradford Woods, PA (US); Andy Smith, Pittsburgh, PA (US); Joseph Williams, Jr., McKees Rocks, PA (US); Colby Myron Coates, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 543 days.

(21) Appl. No.: 16/727,229

(22) Filed: Dec. 26, 2019

(65) Prior Publication Data

US 2021/0202201 A1 Jul. 1, 2021

(51) Int. Cl.
*H01H 71/04* (2006.01)
*H01H 71/00* (2006.01)
(Continued)

(52) U.S. Cl.
CPC ..... *H01H 71/04* (2013.01); *H01H 71/002* (2013.01); *H01H 71/0207* (2013.01);
(Continued)

(58) Field of Classification Search
CPC .... H01H 71/082; H01H 71/002; H01H 71/08; H01H 71/1045; H01H 71/04;
(Continued)

(56) References Cited

U.S. PATENT DOCUMENTS

2019/0164712 A1* 5/2019 Yang ..... H01H 9/16

FOREIGN PATENT DOCUMENTS

JP 05120977 A * 5/1993
JP H05 120977 A 5/1993
(Continued)

OTHER PUBLICATIONS

European Patent Office "International Search Report and Written Opinion", for corresponding application PCT/EP20/25576, Mar. 18, 2021, 18 pp.

*Primary Examiner* — Kevin J Comber
(74) *Attorney, Agent, or Firm* — Eckert Seamans Cherin & Mellott, LLC

(57) ABSTRACT

A safety apparatus is a terminal shield having an indication circuit incorporated therein. The safety apparatus is usable with a circuit interrupter to overlie one or more terminals of the circuit interrupter that are connected with line and load conductors and to thereby form a circuit interrupter apparatus. The safety apparatus can be employed at the line side of a circuit interrupter, at the load side of a circuit interrupter, or at both sides of a circuit interrupter. The safety apparatus can be provided as part of a new circuit interrupter apparatus or can be provided to retrofit existing circuit interrupters. The indication circuit advantageously outputs from a top surface of the terminal shield one of a visual indication and an audible indication when one or more terminals of the circuit interrupter are electrified, thereby easily conveying to a technician the portions of the circuit interrupter that are electrified.

20 Claims, 7 Drawing Sheets

(51) Int. Cl.

| | |
|---|---|
| ***H01H 71/02*** | (2006.01) |
| ***H01H 71/08*** | (2006.01) |
| ***H01H 71/10*** | (2006.01) |
| ***H01R 31/00*** | (2006.01) |
| *H01R 13/66* | (2006.01) |
| *H01R 13/717* | (2006.01) |

(52) U.S. Cl.
CPC ..... *H01H 71/0264* (2013.01); *H01H 71/082* (2013.01); *H01H 71/1045* (2013.01); *H01R 31/005* (2013.01); *H01H 2207/018* (2013.01); *H01H 2219/04* (2013.01); *H01R 13/6691* (2013.01); *H01R 13/717* (2013.01)

(58) Field of Classification Search
CPC ..... H01H 71/0207; H01H 71/0264; H01H 73/20; H01H 73/14; H01H 9/0264; H01H 9/161; H01H 2207/018; H01H 2219/04; H01R 31/005; H01R 13/6691; H01R 13/717
USPC ..... 361/115
See application file for complete search history.

(56) References Cited

FOREIGN PATENT DOCUMENTS

| | | | |
|---|---|---|---|
| JP | 08279329 A | * | 10/1996 |
| JP | H08 279329 A | | 10/1996 |

* cited by examiner

SAFETY APPARATUS HAVING TERMINAL SHIELD WITH INDICATION CIRCUIT, AND CIRCUIT INTERRUPTION APPARATUS

BACKGROUND

Field

The disclosed and claimed concept relates generally to circuit interruption equipment and, more particularly, to a safety apparatus that is formed from a terminal shield having an indication circuit incorporated therein.

Related Art

Numerous types of circuit interruption devices are known for use in protecting certain portions of electrical circuits from undesirable conditions such as overcurrent conditions, under-voltage conditions, and numerous other known conditions. Such circuit interruption devices are typically connected with a line conductor and a load conductor for each phase that is desired to be interruptible. Each pole that interrupts a phase typically includes a set of separable contacts that are movable between a CLOSED state, in which the line and load conductors of any given pole are electrically connected with one another, and an OPEN state in which the line and load conductors of any given pole are electrically disconnected. In a case in which a circuit interrupter includes a plurality of poles, an operating mechanism and other known equipment are employed to simultaneously move all of the poles between the CLOSED state and the OPEN state.

While such circuit interruption devices have been generally effective for their intended purposes, they have not been without limitation. For instance, even though a circuit interrupter might give a visual impression from its exterior that the sets of separable contacts are all in the OPEN state, circuit interrupters can malfunction and can potentially leave one or more poles in the CLOSED state. If it is desired that work be performed on a circuit that includes such a circuit interrupter, a failure to ascertain that a portion of the circuit remains live can potentially have disastrous consequences for a technician performing the work. Furthermore, even if the circuit interrupter has performed properly and has moved all of the sets of separable contacts to the OPEN state, one side of the circuit interrupter typically will remain connected to a number of line conductors which typically will remain electrified. As employed herein, the expression "a number of" and variations thereof shall refer broadly to any non-zero quantity, including a quantity of one. Despite knowing that one side of the circuit interrupter remains electrically connected with live, i.e., electrified, line conductors, the technician cannot always be certain which side of the circuit interrupter is the electrified side and which side is the protected side. Such a situation can become even more uncertain in situations where a circuit can be fed from two directions, such as in a grid-tied photovoltaic application. Improvements thus would be desirable.

SUMMARY

An improved safety apparatus is in the form of a terminal shield having an indication circuit incorporated therein. The safety apparatus is usable with a circuit interrupter to overlie one or more terminals of the circuit interrupter that are connected with line and load conductors and to thereby form an improved circuit interrupter apparatus that is likewise in accordance with the disclosed and claimed concept. The safety apparatus can be employed at the line side of a circuit interrupter, at the load side of a circuit interrupter, or at both sides of a circuit interrupter. The safety apparatus can be provided as part of an improved circuit interrupter apparatus or can be provided to retrofit existing circuit interrupters. The indication circuit advantageously outputs from a top surface of the terminal shield one of a visual indication and an audible indication when one or more terminals of the circuit interrupter are electrified, thereby easily conveying to a technician the portions of the circuit interrupter that are electrified.

Accordingly, an aspect of the disclosed and claimed concept is to provide a safety apparatus in the form of a terminal shield having an indication circuit incorporated therein that is usable with a circuit interrupter having a plurality of terminals, wherein the indication circuit provides at least one of a visual indication and an audible indication when one or more of the terminals that the terminal shield overlies are electrified.

Another aspect of the disclosed and claimed concept is to provide such a safety apparatus wherein a visual indication is output from a top surface of the terminal shield that faces in the same direction as a handle of a circuit interrupter.

Another aspect of the disclosed and claimed concept is to provide such a safety apparatus in conjunction with a circuit interrupter to provide an improved circuit interrupter apparatus.

Another aspect of the disclosed and claimed concept is to provide such an improved circuit interrupter apparatus that can include the safety apparatus at the load side of the circuit interrupter, at the line side of the circuit interrupter, or at both the load and line sides of the circuit interrupter.

Accordingly, an aspect of the disclosed and claimed concept is to provide an improved safety apparatus usable with a circuit interrupter having a housing and an electrical apparatus, the electrical apparatus having a number of poles situated on the housing, the number of poles having a plurality of terminals, the plurality of terminals being structured to be electrically connected with a number of line and load conductors, each pole of the number of poles being electrically connected with a corresponding pair of terminals of the plurality of terminals and including a set of separable contacts that are movable between a CLOSED state wherein the pair of terminals are electrically connected together an OPEN state wherein the pair of terminals are electrically disconnected from one another. The safety apparatus can be generally stated as including a terminal shield that can be generally stated as including a first wall that is structured to overlie at least a portion of at least a first terminal of the plurality of terminals, an indication circuit situated at least in part on the terminal shield and that can be generally stated as including a number of electrical connectors, at least a first electrical connector of the number of electrical connectors being structured to be electrically connected with the at least first terminal, the indication circuit further can be generally stated as including at least a first indicator that is structured to output at least one of a visual indication and an audible indication when the at least first terminal is electrically energized by the number of line and load conductors.

Another aspect of the disclosed and claimed concept is to provide an improved circuit interrupter apparatus that can be generally stated as including a circuit interrupter and a safety apparatus, the circuit interrupter can be generally stated as including a housing and an electrical apparatus, the electrical apparatus can be generally stated as including a number of poles situated on the housing, the number of poles having a plurality of terminals, the plurality of terminals being structured to be electrically connected with a number of line and load conductors, each pole of the number of poles being electrically connected with a corresponding pair of terminals of the plurality of terminals and including a set of separable contacts that are movable between a CLOSED state wherein the pair of terminals are electrically connected together an OPEN state wherein the pair of terminals are electrically disconnected from one another, the safety apparatus can be generally stated as including a terminal shield and an indication circuit, the terminal shield can be generally stated as including a first wall that overlies at least a portion of at least a first terminal of the plurality of terminals, the indication circuit being situated at least in part on the terminal shield and can be generally stated as including a number of electrical connectors, at least a first electrical connector of the number of electrical connectors being structured to be electrically connected with the at least first terminal, the indication circuit further can be generally stated as including at least a first indicator that is structured to output at least one of a visual indication and an audible indication when the at least first terminal is electrically energized by the number of line and load conductors.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
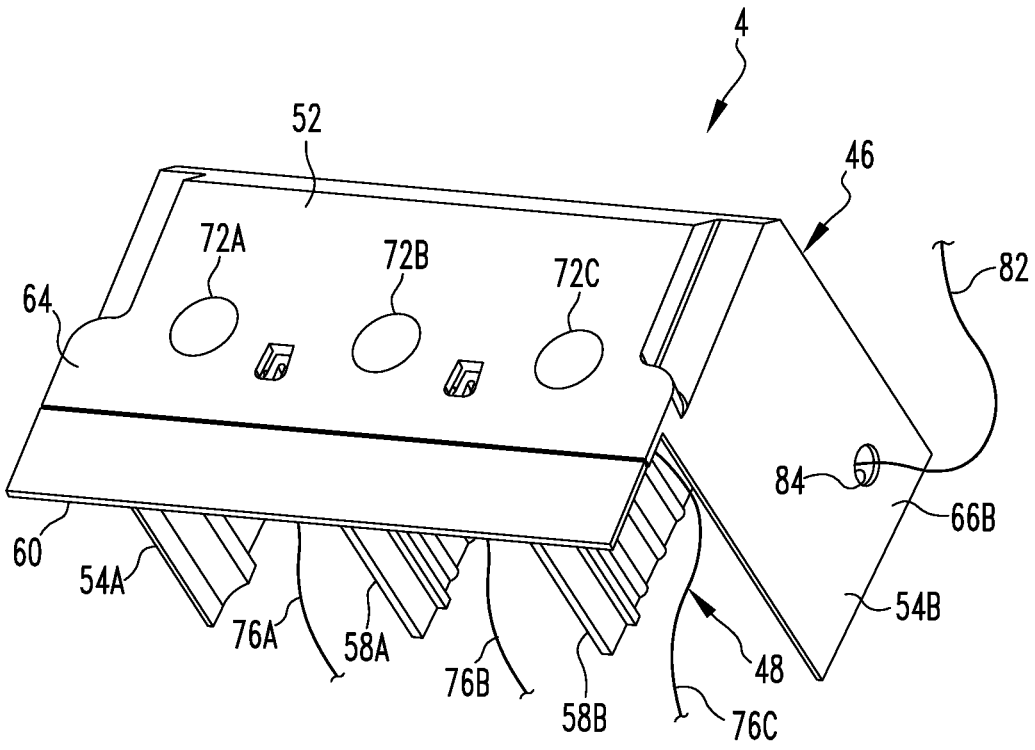
FIG. 1 is a perspective view of an improved safety apparatus in accordance with a first embodiment of the disclosed and claimed concept.

An improved safety apparatus 4 in accordance with a first embodiment of the disclosed and claimed concept is depicted in FIG. 1. As can be understood from FIGS. 2-3, the safety apparatus 4 is usable in conjunction with a circuit interrupter 6 to form an improved circuit interrupter apparatus 10 that is likewise in accordance with the disclosed and claimed concept. While the improved circuit interrupter apparatus 10 of FIGS. 2-5A includes two instance of the safety apparatus 4, which two instances of the safety apparatus 4 are indicated at the numerals 104 as being the safety apparatus 4 that is situated at a first side of the circuit interrupter 6 and at the numeral 204 as being the safety apparatus 4 that is situated at a second side of the circuit interrupter 6, it is understood that both of the safety apparatuses 104 and 204 are also referred to as the safety apparatus 4 and are otherwise identical to one another. It is also understood that while two instances of the safety apparatus 4 are depicted as being employed with the circuit interrupter 6 to form the circuit interrupter apparatus 10, it is understood that in other applications a circuit interrupter can be employed with only a single instance of the safety apparatus 4, at either side of the circuit interrupter, and can still be said to form an improved circuit interrupter apparatus 10 that is in accordance with the disclosed and claimed concept.

As can be understood from FIGS. 2-5A, the circuit interrupter 6 includes a housing 12 which, in the depicted exemplary embodiment, is in the form of a molded case. The circuit interrupter 6 further includes an electrical apparatus 16 that is situated on the housing 12. The electrical apparatus 16 includes a plurality of poles that are indicated at the numerals 18A, 18B, and 18C, which may be collectively or individually referred to herein with the numeral 18. While it can be seen that the circuit interrupter 6 includes a plurality of the poles 18, it is understood that in other embodiments the circuit interrupter 6 could include only a single pole 18, and the safety apparatus 4 that would be used in such an application would correspondingly be configured to be cooperable with a circuit interrupter having a single pole.

The poles 18A, 18B, and 18C each include a set of separable contacts that are indicated at the numerals 22A, 22B, and 22C, respectively and which may be collectively or individually referred to herein with the numeral 22. The electrical apparatus 16 further includes an operating mechanism that is not expressly depicted herein that moves the sets of separable contacts 22 between a CLOSED state such as is depicted generally in FIG. 5 and an OPEN state such as is depicted generally in FIG. 5A. The poles 18A, 18B, and 18C each include a first side conductive element 24A, 24B, and 24C, respectively, and which may be collectively or individually referred to herein with the numeral 24, which is situated at a first side of the corresponding set of separable contacts 22 of the pole 18. The poles 18A, 18B, and 18C additionally include a first side terminal indicated at the numerals 28A, 28B, and 28C, respectively, which may be collectively or individually referred to herein with the numeral 28, with the first side conductive elements 24 of each pole 18 being electrically connected with the corresponding first side terminal 28 of the pole 18. In the depicted exemplary embodiment, the first side terminals 28 are line side terminals that are electrically connected with a set of line conductors that are indicated at the numerals 36A, 36B, and 36C, which may be collectively or individually referred to herein with the numeral 36, The poles 18A, 18B, and 18C each additionally include a corresponding second side conductive element indicated at the numerals 30A, 30B, and 30C that are at a second side of the sets of separable contacts 22 and which may be collectively or individually referred to herein with the numeral 30. Furthermore, the poles 18A, 18B, and 18C each additionally include a corresponding second side terminal indicated at the numerals 34A, 34B, and 34C, and which may be collectively or individually referred to herein with the numeral 34, and which are electrically connected with the corresponding second side conductive element 30 of each pole 18. In the depicted exemplary embodiment, the second side terminals 34 are load side terminals that are electrically connected with a set of load conductors that are indicated at the numerals 38A, 38B, and 38C, which may be collectively or individually referred to herein with the numeral 38.

Figure 5:
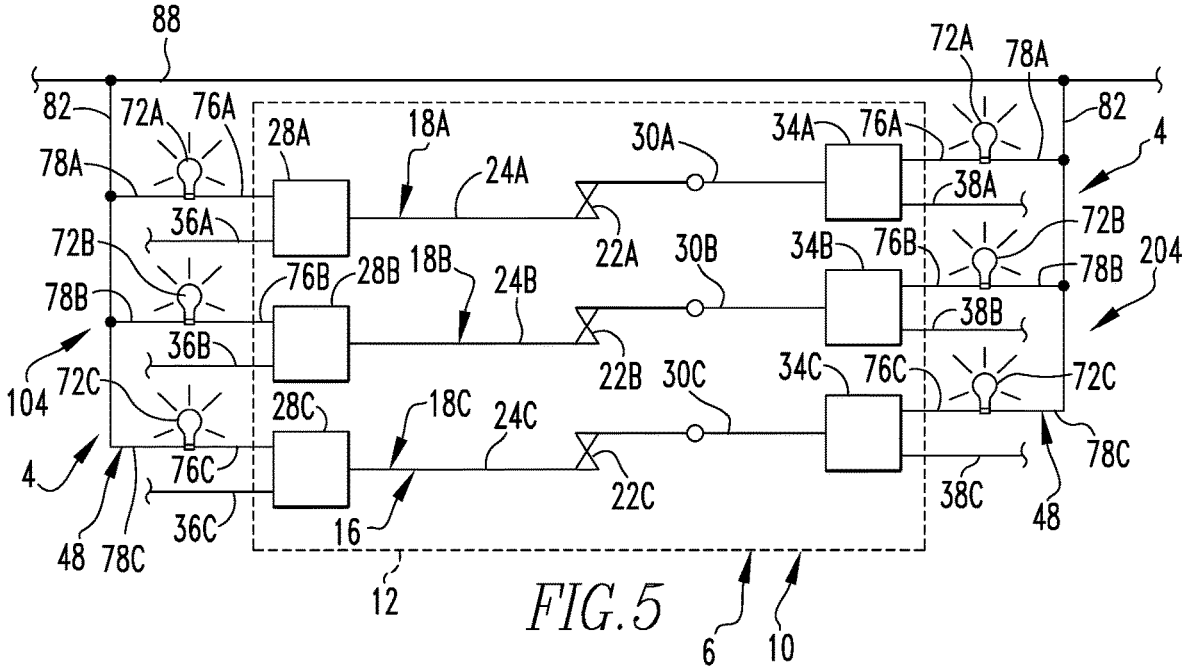
FIGS. 5 and 5A are circuit diagrams of the circuit interrupter apparatus of FIG. 2, with FIG. 5 depicting a plurality of poles of the circuit interrupter apparatus in a CLOSED state, and with FIG. 5A depicting the plurality of poles in an OPEN state.

It thus can be understood that the sets of separable contacts 22, the first side and second side conductive elements 24 and 30 that are situated at first and second sides of the sets of separable contacts 22 and are electrically connected therewith, and that are, in turn, electrically connected with the first and second side terminals 28 and 34, together complete a circuit between the first side terminals 28 and the second side terminals 34 of the poles 18 when the sets of separable contacts 22 are in the CLOSED state such as is depicted generally in FIG. 5 wherein the first side terminals 28 and the corresponding second side terminals 34 are electrically connected with one another. However, and as can be understood from FIG. 5A, the first side terminals 28 are electrically disconnected from the corresponding second side terminals 34 when the sets of separable contacts 22 are in the OPEN state. In this regard, it is understood that the CLOSED state of the sets of separable contacts 22 refers to an ON condition of the circuit interrupter 6 and that the OPEN state of the sets of separable contacts 22 refers to an OFF or a TRIPPED condition of the circuit interrupter 6.

Figure 3:
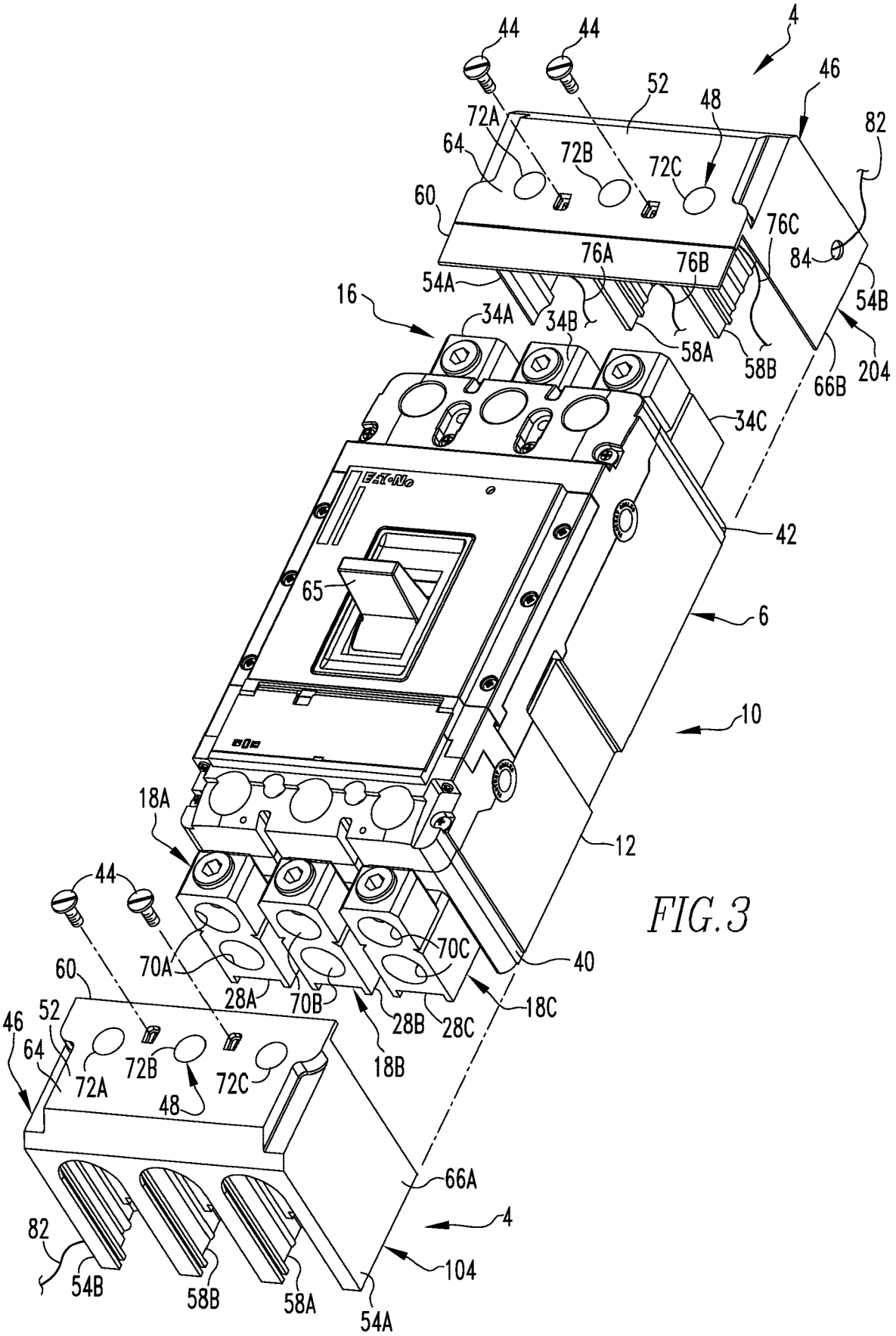
FIG. 3 is an exploded perspective view of the circuit interrupter apparatus of FIG. 2.
Figure 4:
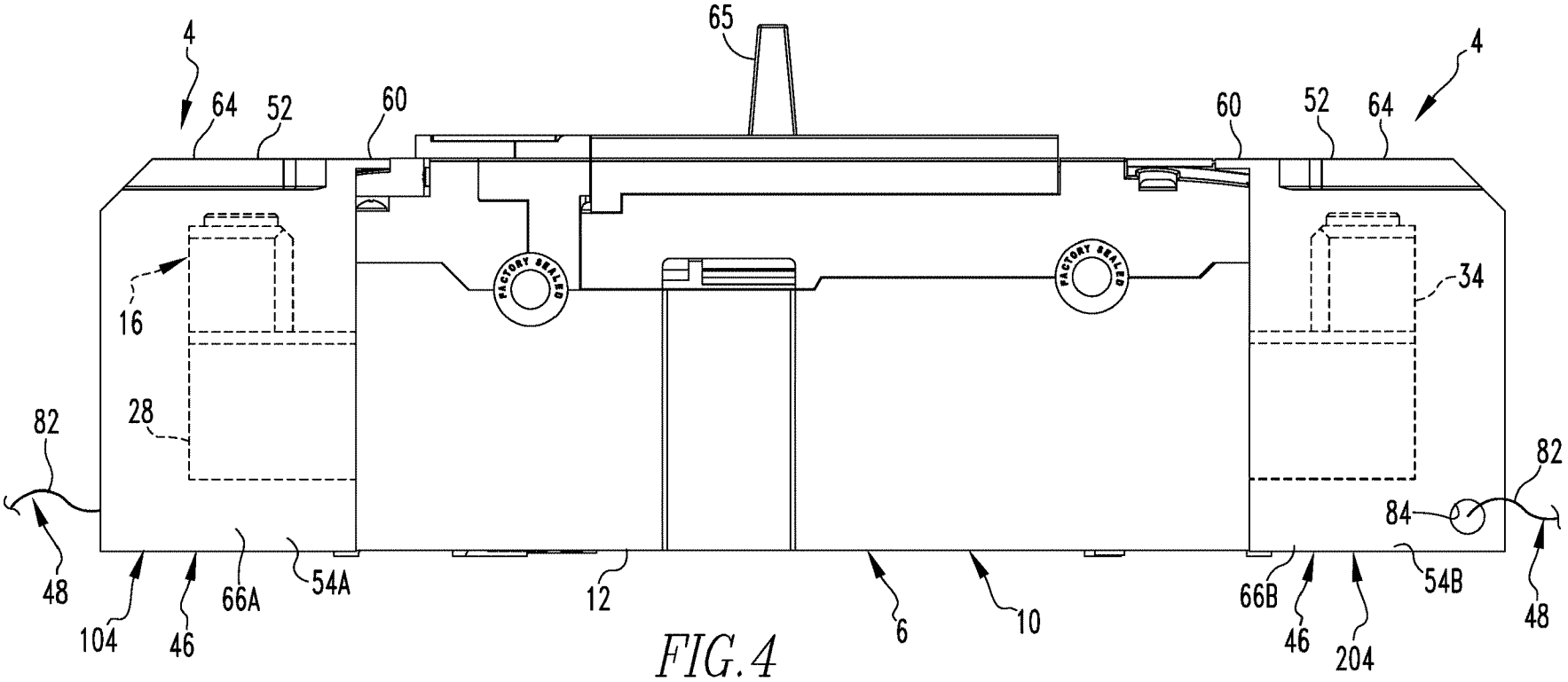
FIG. 4 is a side elevational view of the circuit interrupter apparatus of FIG. 2.

As is best shown in FIG. 3, the housing 12 can be said to include a first seat 40 that receives the first side safety apparatus 104 thereon, and that the housing 12 likewise includes a second seat 42 that receives the second side safety apparatus 204 thereon. A pair of screws 44 are received in holes formed in the safety apparatuses 4 and in corresponding holes formed in the housing 12 to affix the first and second sides safety apparatuses 104 and 204 to the circuit interrupter 6.

The safety apparatus 4 can be said to include a terminal shield 46 and an indication circuit 48, with the indication circuit 48 being incorporated into the terminal shield 46. That is, the indication circuit 48 is situated at least in part upon the terminal shield 46, but as will be set forth in greater detail elsewhere herein, certain portions of the indication circuit 48 depend from or extend from the terminal shield 46 for electrical connection with other structures.

The terminal shield 46 can be said to include a top wall 52 and to further include a pair of side walls 54A and 54B that depend from the top wall 52. The terminal shield 46 further includes a pair of divider walls 58A and 58B that are situated between the side walls 54A and 54B. The top wall 52 includes a lip 60 that protrudes beyond the side walls 54A and 54B and beyond the divider walls 58A and 58B and that overlies a portion of the housing 12 when the safety apparatus 4 is mounted to the circuit interrupter 6.

The top wall 52 can be said to include a top surface 64, a portion of which is generally planar and faces generally away from the circuit interrupter apparatus 10 in the same direction as a handle 65 of the electrical apparatus 16 extends away from the housing 12. The side walls 54A and 54B each include a side surface 66A and 66B, respectively, that are each generally planar and are oriented generally parallel with one another and perpendicular with the top surface 64. The divider walls 58A and 58B are oriented generally parallel with the side walls 54A and 54B.

The indication circuit 48 of the safety apparatus 4 includes a set of visual indicators that are indicated at the numerals 72A, 72B, and 72C, which may be collectively or individually referred to herein with the numeral 72. In the depicted exemplary embodiment, the visual indicators are lights, but it is understood that other types of visual indicators such as visible meters, color-changing indicators, and the like without limitation may be employed as the visual indicators. It is also understood that the visual indicators 72 could instead be replaced with audible indicators such as loudspeakers and the like and still be within the scope of the disclosed and claimed concept.

Figure 2:
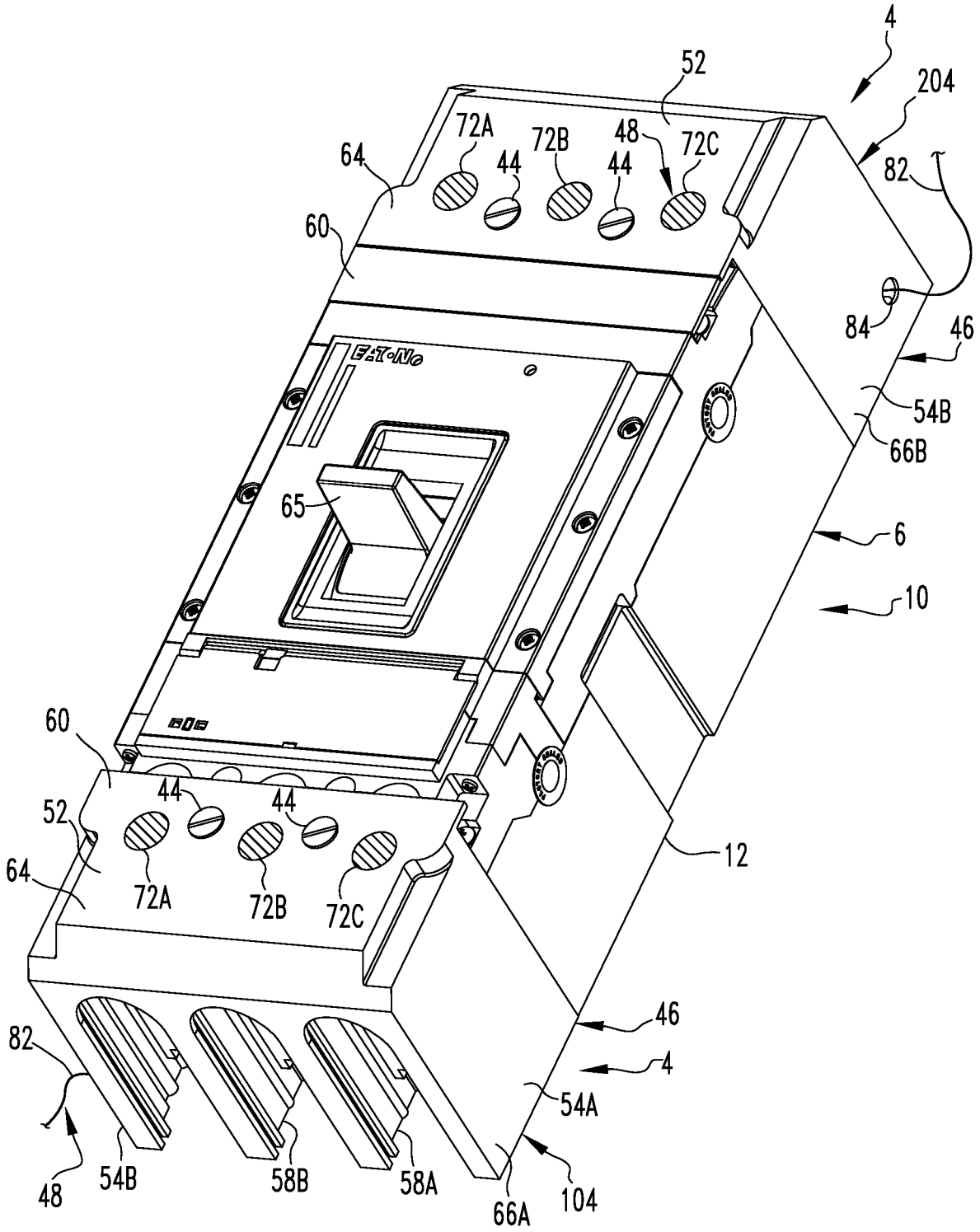
FIG. 2 is a perspective view of an improved circuit interrupter apparatus that includes two instances of the safety apparatus of FIG. 1.

It is noted that the safety apparatus 4 is depicted in FIG. 1 and the second side safety apparatus 204 is depicted in FIGS. 2 and 3 with the visual indicator 72A thereof being situated adjacent the side wall 54A thereof, and with the visual indicator 72C thereof being situated adjacent the side wall 54B thereof. However, it is also noted that the first side safety apparatus 104 is depicted in FIGS. 2 and 3 as the reverse, i.e., with the visual indicator 72A thereof being situated adjacent the side wall 54B thereof, and with the visual indicator 72C thereof being situated adjacent the side wall 54A thereof. Even though the first and second side safety apparatuses 104 and 204 are identical to one another, such reversed numerology with respect to the visual indicators 72 and other components of the indication circuit 48 is employed in herein for reasons of simplicity of disclosure in order to cause, for instance, the visual indicators 72A of both of the first and second side safety apparatuses 104 and 204 to be electrically connected with the pole 18A, by way of example. As such, the reversed numerology in the indication circuits 48 depicted between the first and second side safety apparatuses 104 and 204 is presented merely to enable consistency with regard to connections with the circuit interrupter 6 and are not intended to reflect that the first and second side safety apparatuses 104 and 204 are in any way different from one another.

The indication circuit 48 further includes a set of first electrical connectors 76A, 76B, and 76C, which may be collectively or individually referred to herein with the numeral 76, which are electrically connected with the visual indicators 72, and further includes a set of second electrical connectors that are indicated at the numerals 78A, 78B, and 78C, which may be collectively or individually referred to herein with the numeral 78, which are also electrically connected with the visual indicators 72. As can be understood from FIGS. 5 and 5A, the second electrical connectors 78 are electrically connected together with a common electrical connector 82 that extends through an opening 84 formed in the terminal shield 46 and which is electrically connected with a neutral conductor 88 of the circuit with which the circuit interrupter apparatus 10 is electrically connected.

Figure 5A:
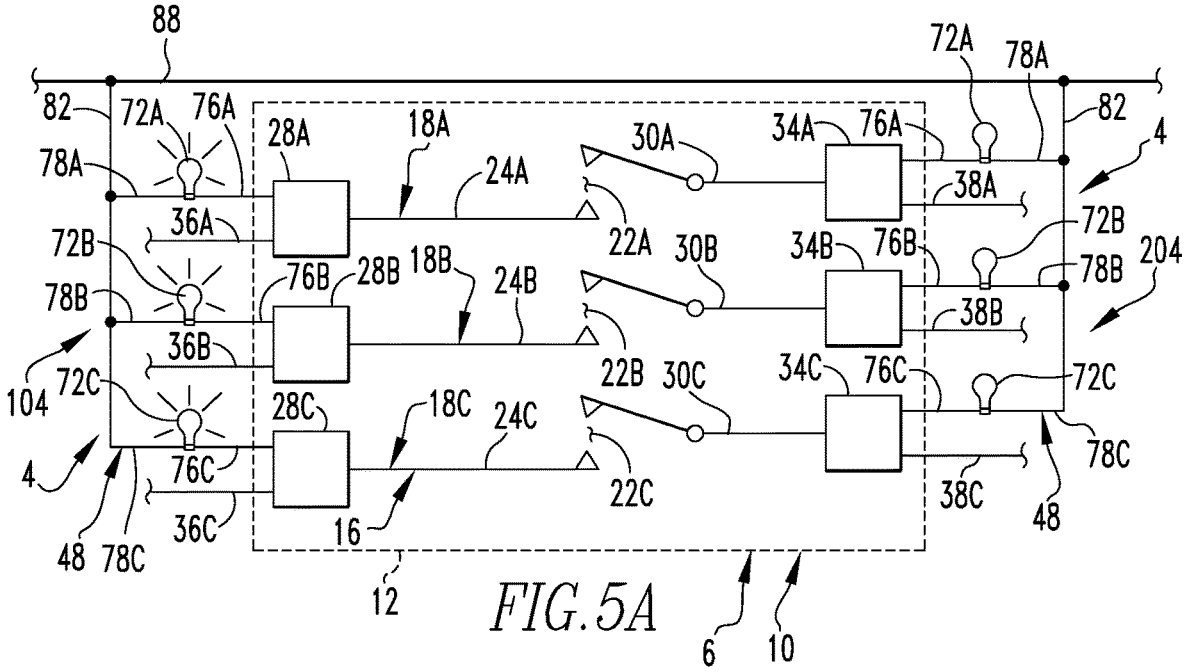
Figure 6:
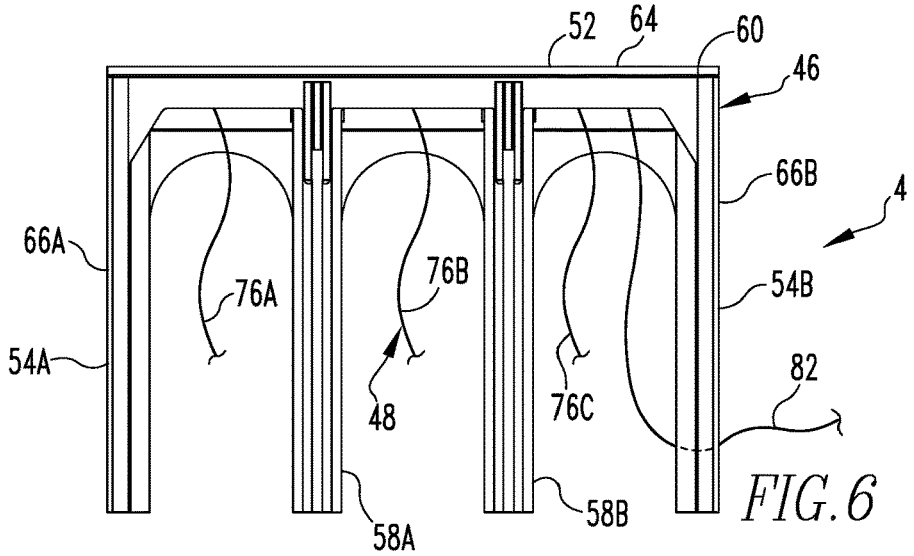
FIG. 6 is an end elevational view of the safety apparatus of FIG. 1.
Figure 7:
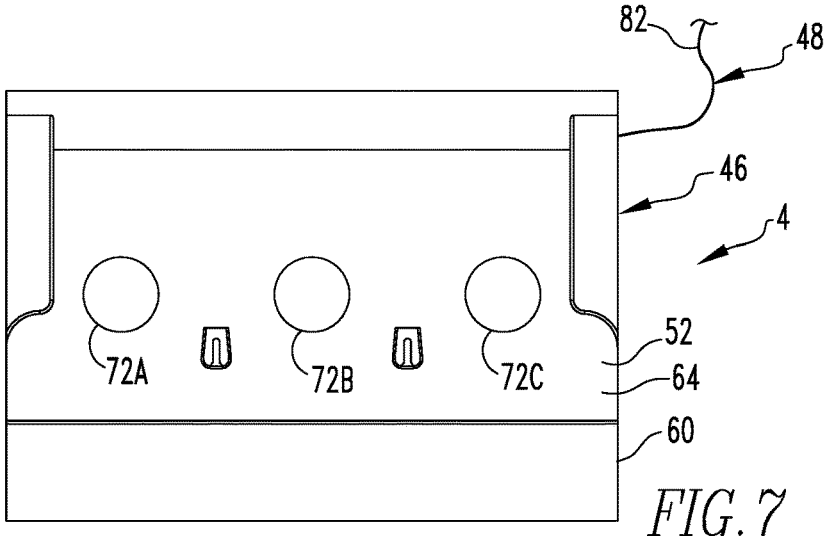
FIG. 7 is a top plan view of the safety apparatus of FIG. 1.
Figure 8:
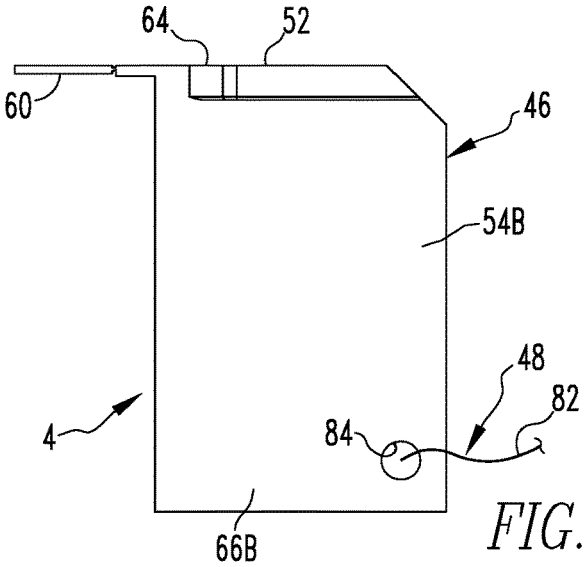
FIG. 8 is a side elevational view of the safety apparatus of FIG. 1.

As can be understood from FIGS. 5 and 5A, the first electrical connectors 76A, 76B, and 76C of the first side safety apparatus 104 are electrically connected with the first side terminals 28A, 28B, and 28C, respectively. In this regard, the first electrical connectors 76 can be received in the holes 70A, 70B, and 70C formed in the first side terminals 28 that also receive therein the line conductors 36, or the first electrical connectors 76 can otherwise be electrically connected with the poles 18 at the first side of the separable contacts in any of a variety of fashions. In this regard, it is understood that the reception of the first electrical connectors 76 in the first side terminals 28 advantageously enables the safety apparatus 4 to be used to retrofit an existing circuit interrupter 6 to form the circuit interrupter apparatus 10. Such reception of the first electrical connectors 76 into electrical connection with the first side terminals 28 and connection of the common electrical connector 82 with the neutral conductor 88 enables rapid installation of the safety apparatus 4 on the first side of the circuit interrupter 6. In installations where the safety apparatus 4 is sold in conjunction with the circuit interrupter 6, other methodologies within the scope of the disclosed and claimed concept can be employed to enable electrical connection between the first electrical connectors 76 and the first side of the electrical apparatus 16, specifically with the first side conductive elements 24 or the first side terminals 28, or both, after the circuit interrupter 6 has been electrically installed and the line and load conductors 36 and 38 have been connected therewith, such as when the safety apparatus 104 is finally installed to overlie the first side terminals 28 and a portion of the housing 12.

The same can be said of the second side safety apparatus 204 with respect to the second side of the electrical apparatus 16. That is, the second side safety apparatus 204 can likewise be sold with the circuit interrupter 6 or can be provided as a retrofit product that can be retrofitted to an existing circuit interrupter 6. It is reiterated that in either situation, the safety apparatus 4 can be received on the first side, the second side, or on both sides of the circuit interrupter 6 to form the improved circuit interrupter apparatus 10.

As can further be understood from FIGS. 5 and 5A, and in the instance of the second side safety apparatus 204 being installed on the circuit interrupter 6, the first electrical connectors 76 are electrically connected with corresponding second side terminals 34 in the same holes in the second side terminals 34 that received the load conductors 38 for electrical connection therewith. The common electrical connector 82 of the second side safety apparatus 24 is likewise electrically connected with the neutral conductor 88.

As can be understood from FIG. 5, and when the circuit interrupter 6 is in the CLOSED state, the first side terminals 28 are electrically energized by the line conductors 36 and, via the set of separable contacts 22, the second side terminals 34 are likewise electrically energized. Since, in the instance of the first side safety apparatus 104, the first and second electrical connectors 76 and 78, along with the corresponding visual indicator 72, complete a circuit between the first side terminals 28 and the neutral conductor 88, each visual indicator 72 will be illuminated whenever its corresponding first side terminal 28 is electrically energized, which occurs due to the electrical connection of the line conductors 36 with the first side terminals 28. When the terminals 34 or 28 are electrically energized the indicators will be energized. The circuit 48 is designed as such to provide the level needed to properly energize the indicators when the terminals 34 or 28 are energized. Since, in FIG. 5, the second side terminals 34 are electrically connected with the first side terminals 28 in the CLOSED state of the circuit interrupter 6 and thus are energized, the circuit that is completed between the second side terminals 34 and the neutral conductor 88 via the first and second electrical connectors 76 and 78 and the visual indicator 72 of the second side safety apparatus 204 results in all of the visual indicators 72 being illuminated in the CLOSED state of the circuit interrupter 6. This is also depicted in FIG. 2 wherein all of the visual indicators 72 are illuminated and thus output a visual indication from the top surface 64 in the same direction as the handle 65 extends out of the housing 12, it being understood that the visual indicators 72 of the first side safety apparatus 104 are overlying the first side terminals 28 and that the visual indicators 72 of the second side safety apparatus w04 are overlying the second side terminals 34. It thus can be seen that the visual indicators 72 advantageously indicate to a technician whether any of the poles 18 is electrically energized at either the first side or the second side of the circuit interrupter 6 due to whether any visual indicator 72 is illuminated.

As can be seen in FIG. 5A wherein the sets of separable contacts 22 are in the OPEN state, the second side terminals 34 which, in the depicted exemplary embodiment, are the load side terminals, are no longer electrically energized inasmuch as the sets of separable contacts 22 no longer complete the circuit between the first side terminals 28 and the second side terminals 34. As such, in the OPEN state of the circuit interrupter 6, the visual indicators 72 of the second side safety apparatus 204 are no longer illuminated, meaning that the second side terminals 34 are no longer electrically energized and thus are safe to be worked upon. It is noted, however, that FIG. 5A depicts the visual indictors 72 of the first side safety apparatus 104 as being illuminated inasmuch as the first side terminals 28 with which the visual indicators 72 are electrically connected remain electrically energized by virtue of the electrically energized line conductors 36 being electrically connected therewith. This would indicate to a technician that even if the circuit breaker is in the OFF or in the TRIPPED conditions, that the circuit interrupter 6 is still electrically energized on its first side. Moreover, the visual indicators 72 of the first side safety apparatus 104 are situated on the top wall 52 of the terminal shield 46 that overlies the first side terminals 28, by way of example, and the positioning of the protective safety apparatus 4 as a terminal shield 46 overlying the first side terminals 28 enables a technician to immediately visualize which terminals of the circuit interrupter 6 remain electrically energized and are therefore dangerous.

As noted, confusion can sometimes exist in a given circuit interrupter installation because whether one physical side of a circuit interrupter is connected with the line conductors 36 or the load conductors 38 may be unclear. By providing the safety apparatus 4 on both sides of the circuit interrupter 6, the technician can rapidly assess whether either or both sides of the circuit interrupter 6 remain energized. For example, if the technician knows that work is to be performed on a certain side of the circuit interrupter 6 but does not know which side is the line side or the load side, the technician can switch the circuit interrupter 6 from the ON condition to the OFF condition and can then visually assess the visual indicators 72. If the visual indicators 72 at the side of the circuit interrupter 6 where the work needs to be performed remain illuminated in the OFF condition of the circuit interrupter, this will advise the technician that another circuit interrupter upstream of the circuit interrupter 6 will need to be switched to its OFF state in order to remove the electrical energy from that side of the circuit interrupter 6.

Moreover, since the indication circuit 48 includes a visual indicator 72 for each of the poles 18, the technician can identify, for instance, a failure of the circuit interrupter 6. For instance, if the circuit interrupter 6 is in its OFF condition, such as in FIG. 5A, but the technician visually observes that the visual indicator 72A of the second side safety apparatus 204 remains illuminated, this would indicate a failure of the circuit interrupter 6 since the second side terminal 34A remains being energized in the OFF state of the circuit interrupter. This will enable the technician to take appropriate safety precautions before accessing the energized portions of the circuit interrupter apparatus 10.

Figure 9:
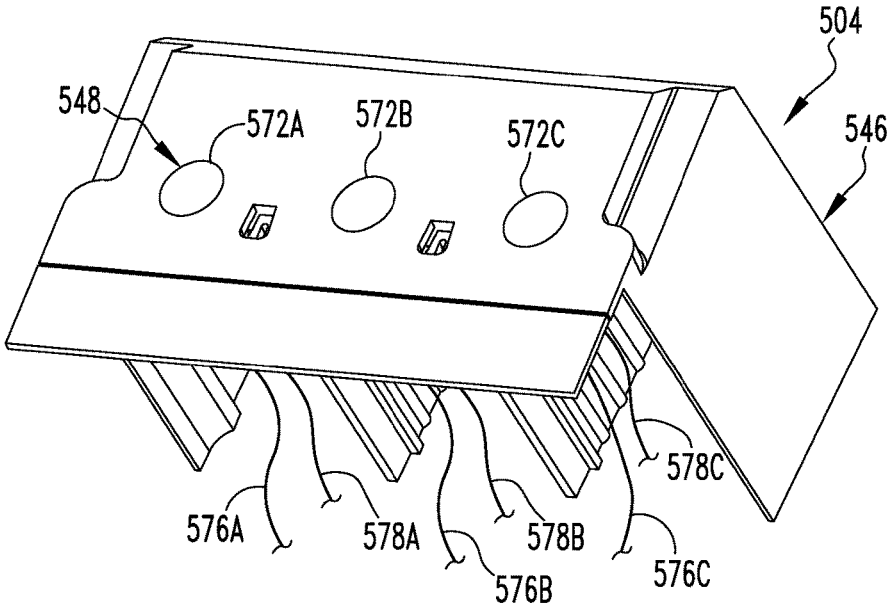
FIG. 9 is a perspective view of an improved safety apparatus in accordance with a second embodiment of the disclosed and claimed concept.
Figure 10:
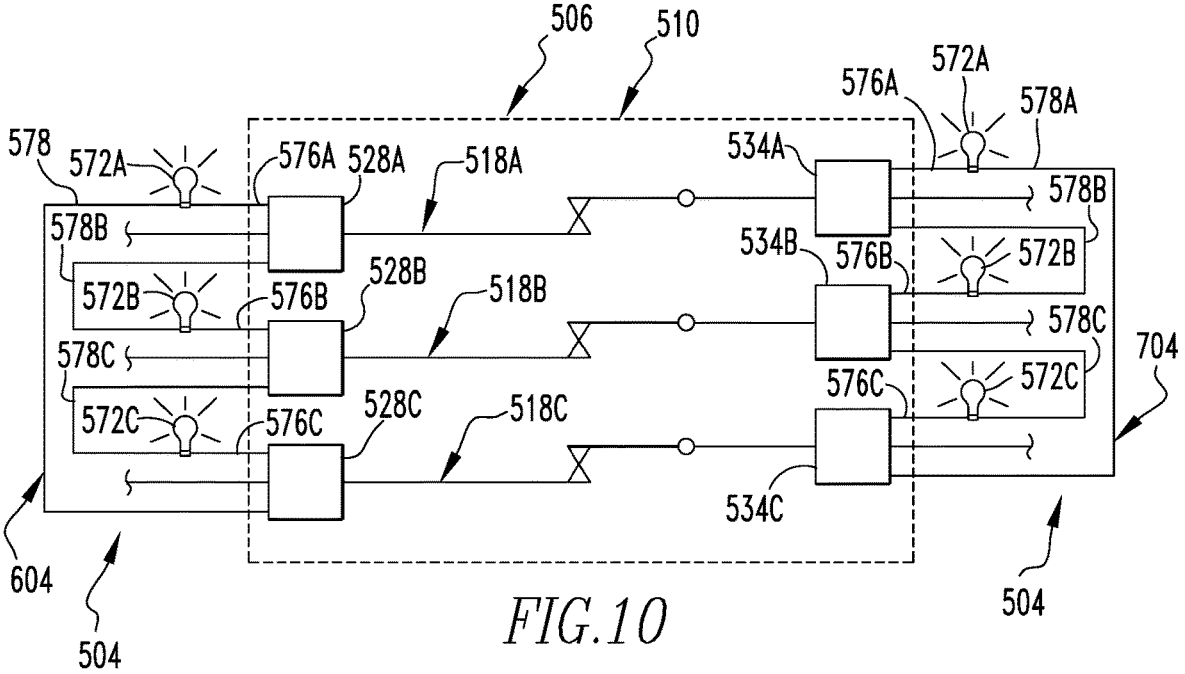
FIG. 10 is a circuit diagram of an improved circuit interrupter apparatus in accordance with a second embodiment of the disclosed and claimed concept and includes two instances of the improved safety apparatus of FIG. 9.

An improved safety apparatus 504 in accordance with a second embodiment of the disclosed and claimed concept is depicted generally in FIG. 9, and two instances of the safety apparatus 504 are depicted in FIG. 10 in conjunction with a circuit interrupter 506 to form an improved circuit interrupter apparatus 510 that is likewise in accordance with the disclosed and claimed concept. The circuit interrupter 506 is identical to the circuit interrupter 6, and the difference between the safety apparatus 504 and the safety apparatus 4 is that the safety apparatus 504 includes an indication circuit 548 that is not connected with a neutral conductor. That is, the safety apparatus 504 includes a terminal shield 546 that is similar to the terminal shield 46, except that the terminal shield 546 does not have an opening 84 through which the common electrical connector 82 extends in the safety apparatus 4.

As can be understood from FIGS. 9 and 10, the indication circuit 548 includes a set of visual indicators that are indicated at the numerals 572A, 572B, and 572C, which may be collectively or individually referred to herein with the numeral 572, and which are, respectively, electrically connected with a set of first electrical connectors 576A, 576B, and 576C, which may be collectively or individually referred to herein with the numeral 576, and with a set of second electrical connectors 578A, 578B, 578C, which may be collectively or individually referred to herein with the numeral 578. Each visual indicator 572 is electrically connected with a pair of the poles 518 rather than being electrically connected between one of the poles 518 and a neutral conductor.

More specifically, the poles 518A, 518B, and 518C each correspondingly include a first side terminal 528A, 528B, and 528C, which may be collectively or individually referred to herein with the numeral 528, and a second side terminal 534A, 534B, and 534C, which may be collectively or individually referred to herein with the numeral 534. It is also noted that the circuit interrupter apparatus 510 includes two instances of the safety apparatus 504, and these two instances are referred to with the numeral 604, which refers to the safety apparatus 504 at the first side of the circuit interrupter 506, and with the numeral 704, which refers to the safety apparatus 504 that is situated at the second side of the circuit interrupter 506. As before, the first and second side safety apparatuses 604 and 704 are identical to one another, and the reversed numerology in FIG. 10 with regard to the indication circuit 548 in each of the first and second side safety apparatuses 604 and 704 is intended to reflect connections with the poles 518A, 518B, and 518C rather than referring to any actual mirror-image type of arrangement of components.

As can be understood from FIG. 10, and in the instance of the first side safety apparatus 604, the first electrical connector 576A is electrically connected with the first side terminal 528A, and the second electrical connector 578A is electrically connected with the first side terminal 528C. The first electrical connector 576B is electrically connected with the first side terminal 528B, and the second electrical connector 578B is electrically connected with the first side terminal 528A. In a similar fashion, the first electrical connector 576C is electrically connected with the first side terminal 528C, and the second electrical connector 578C is electrically connected with the first side terminal 528B. The visual indicators 572 of the second side safety apparatus 704 have a similar electrical connection with the second side terminals 534 wherein each of the visual indicators 572 is electrically connected between a pair of the second side terminals 534 of a pair of separate poles 518.

It thus can be understood that any of the visual indicators 572 will be illuminated when either of the poles 518 between which the visual indicator 572 is electrically connected is energized. As such, the visual indicator 572A will be illuminated whenever either of the poles 518A and 518C is electrically energized at its terminals 528 and 534, respectively. Likewise, the visual indicator 572B will be illuminated whenever either of the poles 518A and 518B is electrically energized at the corresponding terminals 528 and 534. Likewise, the visual indicator 572C will be illuminated whenever of the poles 518B and 518C is electrically energized at the corresponding terminals 528 and 534. Such electrical illumination of the visual indicators 572 advantageously occurs without a need of providing an additional connection with a neutral conductor in order to complete an electrical circuit and is due to the three electrical phases to which the poles 518 are connected are out of phase with one another in an understood fashion. An electrical power system that does not have a neutral conductor is typical when a transformer is connected in a delta configuration. It can be seen that in the event that the circuit interrupter 6 has only a single pole, the safety apparatus 4 with its wiring between the pole and the neutral conductor will need to be provided inasmuch as a plurality of poles would not be provided in a single pole application.

It thus can be seen that the safety apparatuses 4 and 504 and the circuit interrupter apparatuses 10 and 510 advantageously provide a rapid indication to a technician whether any portions of a circuit interrupter 6 and 506 remain energized, and indicate specifically which portions of the circuit interrupters 6 and 506 remain energized. This enables a technician to rapidly assess whether or not certain operations can be performed on the circuit interrupters 6 and 506 or whether additional steps need to be taken in order to make the circuit interrupters 6 and 506 safe for operations being performed thereon. This advantageously saves time and effort and is a safety improvement. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A safety apparatus usable with a circuit interrupter having a housing and an electrical apparatus, the electrical apparatus having a number of poles situated on the housing, the number of poles having a plurality of terminals, the plurality of terminals being structured to be electrically connected with a number of line and load conductors, each pole of the number of poles being electrically connected with a corresponding pair of terminals of the plurality of terminals and including a set of separable contacts that are movable between a CLOSED state wherein the pair of terminals are electrically connected together and an OPEN state wherein the pair of terminals are electrically disconnected from one another, the safety apparatus comprising:

a terminal shield comprising a first wall that is structured to overlie at least a portion of at least a first terminal of the plurality of terminals;

an indication circuit situated at least in part on the terminal shield and comprising a number of electrical connectors, at least a first electrical connector of the number of electrical connectors being structured to be electrically connected with the at least first terminal, a second electrical connector of the number of electrical connectors being structured to be electrically connected with a second terminal of the plurality of terminals, the indication circuit further comprising at least a first indicator that is structured to output at least one of a visual indication and an audible indication when the at least first terminal is electrically energized by the number of line conductors, the indication circuit additionally comprising a second indicator that is structured to output at least one of a visual indication and an audible indication when the second terminal is structured to electrically energize the number of load conductors.

2. The safety apparatus of claim 1 wherein the circuit interrupter comprises a plurality of poles, and wherein a pair of electrical connectors of the number of electrical connectors are electrically connected with the at least first indicator, an electrical connector of the pair of electrical connectors being the at least first electrical connector, another electrical connector of the pair of electrical connectors being structured to be electrically connected with a terminal of the corresponding pair of terminals with which another pole of the plurality of poles is electrically connected, the at least first indicator being structured to output the at least one of the visual indication and the audible indication when at least one of the at least first terminal and the terminal is electrically energized by the number of line and load conductors.

3. The safety apparatus of claim 2 wherein:

the plurality of poles further comprise an additional pole;

the indication circuit further comprising a second indicator and a third indicator;

another pair of electrical connectors of the number of electrical connectors being electrically connected with the second indicator, an electrical connector of the another pair of electrical connectors being structured to be electrically connected with the terminal, another electrical connector of another pair of electrical connectors being structured to be electrically connected with one terminal of the corresponding pair of terminals with which the additional pole is electrically connected, the second indicator being structured to output at least one of a visual indication and an audible indication when at least one of the terminal and the one terminal is electrically energized by the number of line and load conductors; and an additional pair of electrical connectors of the number of electrical connectors being electrically connected with the third indicator, an electrical connector of the additional pair of electrical connectors being structured to be electrically connected with the one terminal, another electrical connector of additional pair of electrical connectors being structured to be electrically connected with the at least first terminal, the third indicator being structured to output at least one of a visual indication and an audible indication when at least one of the one terminal and the at least first terminal is electrically energized by the number of line and load conductors.

4. The safety apparatus of claim 3 wherein the at least first indicator, the second indicator, and the third indicator are each situated on the first wall.

5. The safety apparatus of claim 1 wherein a pair of electrical connectors of the number of electrical connectors are electrically connected with the at least first indicator, an electrical connector of the pair of electrical connectors being the at least first electrical connector, another electrical connector of the pair of electrical connectors being structured to be electrically connected with a neutral conductor.

6. The safety apparatus of claim 5 wherein:

the plurality of poles further comprise another pole and an additional pole;

the indication circuit further comprising a second indicator and a third indicator;

another pair of electrical connectors of the number of electrical connectors being electrically connected with the second indicator, an electrical connector of the another pair of electrical connectors being structured to be electrically connected with a terminal of the corresponding pair of terminals with which the another pole is electrically connected, another electrical connector of another pair of electrical connectors being structured to be electrically connected with the neutral conductor, the second indicator being structured to output at least one of a visual indication and an audible indication when the terminal is electrically energized by the number of line and load conductors; and an additional pair of electrical connectors of the number of electrical connectors being electrically connected with the third indicator, an electrical connector of the additional pair of electrical connectors being structured to be electrically connected with one terminal of the corresponding pair of terminals with which the additional pole is electrically connected, another electrical connector of additional pair of electrical connectors being structured to be electrically connected with the neutral conductor, the third indicator being structured to output at least one of a visual indication and an audible indication when the one terminal is electrically energized by the number of line and load conductors.

7. The safety apparatus of claim 6 wherein the at least first indicator, the second indicator, and the third indicator are each situated on the first wall.

8. The safety apparatus of claim 7 wherein the terminal shield further comprises a pair of side walls that are connected with the first wall and that are situated at opposite sides of the first wall, the first wall having a first wall surface that is generally planar, the pair of side walls each having a side wall surface that is generally planar, the side wall surfaces being oriented generally parallel with one another and being oriented substantially perpendicular to the first wall surface, the at least first indicator, the second indicator, and the third indicator each being structured to output a visual indication outwardly from the first surface.

9. The safety apparatus of claim 8 wherein the terminal shield further comprises a pair of divider walls that are connected with the first wall and that are situated generally between the pair of side walls, the pair of divider walls being oriented generally parallel with one another and with the pair of side walls.

10. A circuit interrupter apparatus comprising:

a circuit interrupter;

a safety apparatus;

the circuit interrupter comprising a housing and an electrical apparatus;

the electrical apparatus comprising a number of poles situated on the housing, the number of poles having a plurality of terminals, the plurality of terminals being structured to be electrically connected with a number of line and load conductors;

each pole of the number of poles being electrically connected with a corresponding pair of terminals of the plurality of terminals and including a set of separable contacts that are movable between a CLOSED state wherein the pair of terminals are electrically connected together and an OPEN state wherein the pair of terminals are electrically disconnected from one another;

the safety apparatus comprising a terminal shield and an indication circuit;

the terminal shield comprising a first wall that overlies at least a portion of at least a first terminal of the plurality of terminals;

the indication circuit being situated at least in part on the terminal shield and comprising a number of electrical connectors, at least a first electrical connector of the number of electrical connectors being structured to be electrically connected with the at least first terminal, a second electrical connector of the number of electrical connectors being structured to be electrically connected with a second terminal of the plurality of terminals, the indication circuit further comprising at least a first indicator that is structured to output at least one of a visual indication and an audible indication when the at least first terminal is electrically energized by the number of line conductors, the indication circuit additionally comprising a second indicator that is structured to output at least one of a visual indication and an audible indication when the second terminal is structured to electrically energize the number of load conductors.

11. The circuit interrupter apparatus of claim 10 wherein the circuit interrupter comprises a plurality of poles, and wherein a pair of electrical connectors of the number of electrical connectors are electrically connected with the at least first indicator, an electrical connector of the pair of electrical connectors being the at least first electrical connector, another electrical connector of the pair of electrical connectors being structured to be electrically connected with a terminal of the corresponding pair of terminals with which another pole of the plurality of poles is electrically connected, the at least first indicator being structured to output the at least one of the visual indication and the audible indication when at least one of the at least first terminal and the terminal is electrically energized by the number of line and load conductors.

12. The circuit interrupter apparatus of claim 11 wherein:

the plurality of poles further comprise an additional pole;

the indication circuit further comprising a second indicator and a third indicator;

another pair of electrical connectors of the number of electrical connectors being electrically connected with the second indicator, an electrical connector of the another pair of electrical connectors being structured to be electrically connected with the terminal, another electrical connector of another pair of electrical connectors being structured to be electrically connected with one terminal of the corresponding pair of terminals with which the additional pole is electrically connected, the second indicator being structured to output at least one of a visual indication and an audible indication when at least one of the terminal and the one terminal is electrically energized by the number of line and load conductors; and an additional pair of electrical connectors of the number of electrical connectors being electrically connected with the third indicator, an electrical connector of the additional pair of electrical connectors being structured to be electrically connected with the one terminal, another electrical connector of additional pair of electrical connectors being structured to be electrically connected with the at least first terminal, the third indicator being structured to output at least one of a visual indication and an audible indication when at least one of the one terminal and the at least first terminal is electrically energized by the number of line and load conductors.

13. The circuit interrupter apparatus of claim 12 wherein the at least first indicator, the second indicator, and the third indicator are each situated on the first wall.

14. The circuit interrupter apparatus of claim 10 wherein a pair of electrical connectors of the number of electrical connectors are electrically connected with the at least first indicator, an electrical connector of the pair of electrical connectors being the at least first electrical connector, another electrical connector of the pair of electrical connectors being structured to be electrically connected with a neutral conductor.

15. The circuit interrupter apparatus of claim 14 wherein:

the plurality of poles further comprise another pole and an additional pole;

the indication circuit further comprising a second indicator and a third indicator;

another pair of electrical connectors of the number of electrical connectors being electrically connected with the second indicator, an electrical connector of the another pair of electrical connectors being structured to be electrically connected with a terminal of the corresponding pair of terminals with which the another pole is electrically connected, another electrical connector of another pair of electrical connectors being structured to be electrically connected with the neutral conductor, the second indicator being structured to output at least one of a visual indication and an audible indication when the terminal is electrically energized by the number of line and load conductors; and an additional pair of electrical connectors of the number of electrical connectors being electrically connected with the third indicator, an electrical connector of the additional pair of electrical connectors being structured to be electrically connected with one terminal of the corresponding pair of terminals with which the additional pole is electrically connected, another electrical connector of additional pair of electrical connectors being structured to be electrically connected with the neutral conductor, the third indicator being structured to output at least one of a visual indication and an audible indication when the one terminal is electrically energized by the number of line and load conductors.

16. The circuit interrupter apparatus of claim 15 wherein the at least first indicator, the second indicator, and the third indicator are each situated on the first wall.

17. The circuit interrupter apparatus of claim 16 wherein the terminal shield further comprises a pair of side walls that are connected with the first wall and that are situated at opposite sides of the first wall, the first wall having a first wall surface that is generally planar, the pair of side walls each having a side wall surface that is generally planar, the side wall surfaces being oriented generally parallel with one another and being oriented substantially perpendicular to the first wall surface, the at least first indicator, the second indicator, and the third indicator each being structured to output a visual indication outwardly from the first surface.

18. The circuit interrupter apparatus of claim 17 wherein the terminal shield further comprises a pair of divider walls that are connected with the first wall and that are situated generally between the pair of side walls, the pair of divider walls being oriented generally parallel with one another and with the pair of side walls.

19. The circuit interrupter apparatus of claim 10 wherein the terminal shield overlies at least a portion of the housing.

20. The circuit interrupter apparatus of claim 10 wherein the at least first terminal is electrically connected with a pole of the number of poles at a first side of the set of separable contacts of the pole and is a terminal of the corresponding pair of terminals with which the pole is electrically connected;

another terminal of the plurality of terminals being electrically connected with the pole at a second side of the set of separable contacts and being another terminal of the corresponding pair of terminals with which the pole is electrically connected;

the safety apparatus comprising another terminal shield and another indication circuit;

the terminal shield comprising another first wall that overlies at least a portion of the another terminal;

the another indication circuit being situated at least in part on the another terminal shield and comprising another number of electrical connectors, at least a first electrical connector of the another number of electrical connectors being structured to be electrically connected with the another terminal, the indication circuit further comprising another indicator that is structured to output at least one of a visual indication and an audible indication when the another terminal is electrically energized by the number of line and load conductors.

* * * * *